US005566943A

United States Patent [19]

Boehm

[11] Patent Number: 5,566,943

[45] Date of Patent: Oct. 22, 1996

[54] GOLF BALL

[75] Inventor: Herbert C. Boehm, Norwell, Mass.

[73] Assignee: Acushnet Company, Fairhaven, Mass.

[21] Appl. No.: 367,630

[22] Filed: Jan. 3, 1995

[51] Int. Cl.[6] ..... A63B 37/14

[52] U.S. Cl. ..... 473/384

[58] Field of Search ..... 273/232, 62, 220, 273/235 R, 233; 40/327

[56] References Cited

U.S. PATENT DOCUMENTS

| | | | |
|---|---|---|---|
| 878,254 | 2/1908 | Taylor | 273/232 |
| 1,418,220 | 5/1922 | White | 273/232 |

FOREIGN PATENT DOCUMENTS

| | | | |
|---|---|---|---|
| 8464 | of 1911 | United Kingdom | 273/232 |
| 2103939 | 3/1983 | United Kingdom | 273/232 |

*Primary Examiner*—George J. Marlo
*Attorney, Agent, or Firm*—Pennie & Edmonds

[57] ABSTRACT

A golf ball in the shape of a sphere having a core and an outer cover, said cover defining an outer surface with a plurality of non-annular dimples in said outer surface, each dimple having a predetermined dimple perimeter on said outer surface to define an enclosed area having a diameter the improvement wherein:

a) each dimple has a bottom surface area spaced radially inwardly of said outer surface;

b) said bottom surface area is substantially equal to the enclosed area defined by said perimeter; and c) said bottom surface area is a constant depth from said outer surface along said diameter.

7 Claims, 2 Drawing Sheets

GOLF BALL

BACKGROUND OF THE INVENTION

The first golfs balls were leather with a wet feather filling. As the ball dried the feathers expanded and the leather casing shrank giving the final ball a relatively smooth exterior and resilience. These "feathery" golf balls were used from the 14th and 15th centuries up until about the mid 19 century (see "Golf Balls", Golf For Women, May/June 1989, page 71). In 1848 a single piece golf ball called the "gutty" was introduced. This ball was made of gutta-percha, a packing material then used in imports from china. The "gutty" did not fly as well as the "feathery", however the "gutty" was less expensive, and lead to a wider acceptance of the game of golf among the middle and lower classes (see "The Curious History Of The Golf Ball" by John Martin, Horizon Press, New York 1968).

After introduction of the "gutty", it was noted that an older golf ball would often travel farther than a new golf ball. This was attributed to the nicks and scratches on the surface of the golf balls (see "Golfers Always Have A Ball" Professional Golfer, August 1967). Subsequently, different methods of adding markings at the surface of the balls were developed. This eventually lead to the development of the complex dimple patterns in use on golf balls today.

The primary purpose of dimples on a golf ball is to induce the balls boundary layer to transition from laminar to turbulent at an artificially low Reynolds Number, well within the range experienced by a golf ball under normal conditions. On a smooth ball, the transition occurs naturally at a Reynolds Number substantially outside of this range. For a golf ball, the advantage of a turbulent boundary layer is twofold: it dramatically decreases the aerodynamic drag experienced by the ball as it flies through the air; and, it increases and stabilizes the aerodynamic lift. This allows a dimpled ball to fly much farther than a smooth one. In fact, under identical driving conditions a dimpled ball will fly 100 to 150 yards farther than a smooth one.

The dimple patterns that can be used on golf balls vary greatly, with a majority of the patterns in use before the modern spherical or saucer (elliptical) shaped dimples being illustrated in "Antique Golf Ball Reference and Price Guide" by Leo M. Kelly, Old Chicago Golf Shop, Illinois 1993. Modern Dimple patterns and dimple profiles are perhaps best illustrated by those designs found in U.S. Pat. No. 4,936,587, assigned to Acushnet Company, which have garnered wide acceptance and use in the golf ball industry. Despite the use of a large variety of dimple patterns on golf balls there exists a continuing need for dimple patterns that allow for the production of golf balls that have better properties and/or which are easier to manufacture than prior art golf balls.

Golf balls can be used in variety of circumstances ranging from a professional golf tournament to a driving range. In each of these situations golf balls suffer from the wear and tear a ball is subjected to by being hit at great force with a golf club. In particular, iron type clubs having aggressive groove configurations can cause substantial abrasion damage to the ball's surface, which in extreme cases can negatively affect the flight performance. It also damages the cosmetic markings and symbols on the ball's surface, making them difficult to read. Accordingly, there is a continuing need for golf balls which have symbols that are readable for longer periods of time than golf balls of the prior art.

Prior patents have disclosed varying golf ball depression configurations, such as flat bottom dimples (U.S. Pat. No. 878,254); grooves with constant depth portions (U.S. Pat. No. 4,284,276) and circular dimples having depths related to a chord across the dimple (U.S. Pat. No. 4,979,747). However none of these prior art balls overcomes as many of the problems in the prior art as golf balls made according to the present invention.

Furthermore, none of these prior disclosures provides the dimple configuration of the present invention and the advantages it provides.

In spite of the dimples of the prior art which have circular or elliptical profiles, there is a continuing need in the art for golf balls having dimple configurations which impart improved performance properties.

Further, there is a need in the art for golf balls which provide improved contact between the club head and golf ball.

Also, there is a continuing need for golf balls which have been resistance to damage by abrasion with the club face.

SUMMARY OF THE INVENTION

The present invention is directed to golf balls having dimples of a constant depth.

The present invention is further directed to golf balls having improved performance properties for golf players of various skill levels.

The present invention is still further directed to golf balls providing improved contact between the club head and ball.

The present invention is still yet further directed to golf balls having improved cut resistance and abrasion resistance.

The present invention is also directed to golf balls which look different that prior art golf balls.

In addition, the present invention is directed to golf balls having a clear cover which will allow the reading of symbols appearing on the ball core beneath the cover layer.

The present invention is directed to golf balls having a surface with a plurality of dimples on such surface comprising a dimple with a perimeter and a bottom substantially the same size as the dimple opening and in which the bottom is at a constant depth from the ball surface.

The present invention is also directed to a golf ball having a surface pattern comprising at least one dimple wherein the dimple comprises an opening on the spherical surface farthest from the center of the ball and wherein each dimple has a bottom which has substantially the same dimensions as the opening and in which the entire surface of the bottom of the dimple is equidistant from the center of the ball.

The present invention is further directed to a golf ball having at least one dimple, each of said at least one dimples having a side wall which is at an angle of about 90 degrees to the point where the surface meets the side wall, and a bottom which is at a constant depth from the surface and which is at an angle of about 90 degrees to the side wall.

The present invention is directed to a dimpled golf ball having a spherical surface with a plurality of dimples therein. Dimples have perimeters in such spherical surface which dimples having a constant depth. Preferably all dimples have the same constant depth but less than all may be so constructed.

DETAILED DESCRIPTION OF THE INVENTION

Figure 1:
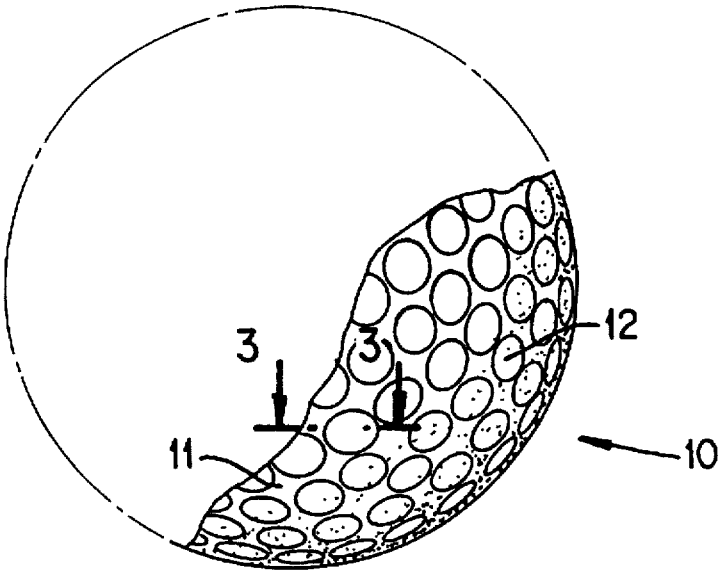
FIG. 1 is a partial plan view of the golf ball of the present invention.

For purposes of this invention "constant depth" means that every point of the bottom surface of the dimple is approximately equidistant from the center of the golf ball, on whose surface they appear.

The term sidewall as used herein refers to that portion of the dimple that is between the outermost surface of the golf ball and the bottom of the dimple.

Further, the term perimeter is the closed curve which demarcates the side wall of the dimple from the outermost surface of the golf ball. Also for non-circular dimples, the diameter is defined to be the diameter of a circle having the same perimeter length.

The constant depth dimple of the present invention refer to dimples which appear on the surface of a golf ball and have a constant depth.

The shape of the perimeter of dimples can be any geometric design which is advantageous for use on golf balls. These geometric shapes would include circular, elliptical, octagonal, heptagonal, hexagonal, square, rectangular, triangular and rhombic. Geometric shapes having more than a number of sides N, greater than 4 can be used and are preferred as they have angles greater than 90° and are closer to the more aerodynamically preferred shapes such as circular and elliptical. The most preferred shape is circular. Combinations of two or more shapes may also be used, such as, dimple patterns using circular and elliptical or square and triangular combinations of shapes.

The size of the dimple is also variable. The dimple perimeter length can vary from about 0.15 to 0.95 inches, regardless of the shape of the perimeter of the dimple. For circular dimples the preferred range of perimeter length is from about 0.25 to about 0.63 inches (diameters from about 0.08 to about 0.20 inches). Most preferred are circular dimples having a perimeter of from about 0.38 to about 0.50 inches (diameters from about 0.12 to about 0.16 inches).

Combinations of dimples having different perimeter sizes are also possible. U.S. Pat. Nos. 4,560,169 and 4,813,677 disclose golf balls having dimple patterns incorporating dimples having different size perimeters. Golf balls according to the present invention can have any number of dimples having different perimeter sizes, from all the dimples having the same perimeter size to each dimple having a different perimeter size. In a preferred embodiment of the invention the golf ball will have a dimple pattern containing from about 1 to about 11 different perimeter length dimples.

The number of dimples on the golf ball can be varied to obtain different performance characteristics such as distance and trajectory shape. Dimple number can also depend on the size and shape of the dimples. The number of dimples can vary from about 60 to about 1,000. The preferred range of dimples is from about 300 to about 500. The most preferred number of dimples is from about 350 to about 450.

The depth of the dimples can be varied to change the various performance characteristics of the golf balls according to such parameters as the skill of the player. The range of the depths can be from about 1% to about 25% of the dimple diameter. The preferred range of depth is from about 2.5% to about 8%. The most preferred depth is from about 3.5% to about 5.0%. Different depths can be used to impart different performance characteristics to the final golf ball.

Constant depth dimples according to the most preferred embodiment of the claimed invention having a reduced depth requirement have certain advantages. First, it provides fuller contact between the ball surface and the club face during impact, since the dimple bottom will contact the club face with very little deformation of the ball's cover material. With deeper conventional dimples, the dimple bottom will not contact the club face unless the cover material is quite soft and deformable (as in a balata-covered ball), and the swing speed is very high (as with a driver club). The increased contact area of the constant depth dimple ball makes it possible to impart more spin to the ball on short iron shots. It also helps reduce cover damage due to abrasion between the club face and the ball on such shots.

In a separate embodiment of the present invention the bottom of the described constant depth dimple can be annular and have a protrusion or depression which can change the aerodynamics of the golf ball. Such a protrusion can be, for example, a half sphere that is centered on the bottom of the dimple. This embodiment can include those circumstances where the bottom is textured and the sidewalls are still approximately 90°.

The dimples of the present invention are contemplated as having sidewalls that can form as close to a 90° angle as is possible. Small variations in this angle (±27°, more preferably ±17.5°, most preferred ±12°) are possible due to tolerances of machining the molds in which the balls are made. This specifically refers to the almost impossibility of achieving an exact 90° angle at the point where the sidewall meets the bottom. Also, painting or coating the ball can effect the angle that the sidewall meets the bottom on a finished ball in that any coating material can change the angle at which the sidewall meets the bottom by filling in some amount of the preferred 90° angle. It is preferred that the sidewall, if extended pass directly through the center of the ball, such that the sidewall would form a radius of the golf ball. It has been found that golf balls having dimples of this type have better optical properties for reading through the cover material to read information printed on the golf ball core when using a clear or transparent cover.

The percentage of the total surface area of the golf ball that is taken up by dimples is also variable. Golf balls according to the present invention can have more than about 25% of the surface of the ball covered with dimples. Preferably the balls have from about 65% to about 85% dimple coverage. Most preferred the dimples take up from about 75% to about 85% of the surface of the balls.

The constant depth dimples of the present invention can be used on any type and kind of golf ball. In particular, constant depth dimples can be used on golf balls having a solid one piece core, a solid two piece core, a wound core, and a liquid center core, to name but a few. Cores comprising a smaller inner core and a larger concentric outer core made from the same or different material as the inner core can also be used in conjunction with the constant depth dimple covering of the present invention.

Golf balls of varying size can also be used according to the present invention. USGA specification conformance dictates that a golf ball must have a diameter of at least 1.680 inches. However, non USGA conformance golf balls can be any size. Golf balls according to the present invention can range from 1.5 inches to 2.5 inches. The preferred range of diameters of golf balls having a constant depth dimple pattern is from about 1.680 to about 1.80 inches. The most preferred range is however from about 1.680 to about 1.750 inches.

The nature of the constant depth dimples does not change the material dynamics of the underlying golf balls and cores can be made of any type of material that is suitable for use in other golf balls. The preferred materials are thermoplastic elastomers. Most preferred are cores comprising polybutadiene. Additional ingredients, such as pigments, fillers, crosslinking agents, lubricants and mold release agents can also be added to the cores for use with the subject constant depth dimple golf balls.

Any materials that can be used in golf ball covers can also be used with the constant depth dimple patterns of the present invention. These materials are well known in the art and some are detailed in U.S. Pat. Nos. 4,911,451, and 3,421,766. Specifically, ionic copolymers of an olefin having from 2 to 8 carbon atoms and a metal salt of an unsaturated monocarboxylic acid containing from 2 to 8 carbon atoms are preferred. An additional unsaturated monomer of the acrylate ester class having from 1–21 carbon atoms can be copolymerized with the aforementioned copolymers to impart a desired degree of softness of the golf ball covers. Other polymers such as polyurethanes, polyethylenes, polystyrenes, polyisoprenes and polypropylenes may also be used alone or in combination to produce other cover compositions.

Golf balls having a cover made of two or more distinct layers can also be used according to the claimed invention. Such covers are disclosed for example in U.S. Pat. No. 4,431,193, which is herein incorporated by reference in its relevant parts. In particular, a golf ball having a multi layer cover comprising a hard inner layer which can comprise an ionomer such as a lithium SURLYN®, and a softer outer layer such as a poly isoprene compound or a very low modulus ionomer such as those mentioned in the DuPont Surlyn Guide, which is herein incorporated by reference in its entirety. In a preferred embodiment the golf ball comprises a smaller sphere made of at least some of the hard ionomer cover with a second covering over the sphere comprising the soft ionomer or a thermoplastic elastomer, and wherein the second covering has apertures with distinct sidewalls such that the sidewalls have angles with respect to the inner cover to form a dimple bottom as described above.

In an alternate embodiment of the present invention a clear cover material is used to cover a core on which appears writing, symbols, trademarks, specifications etc. (see for example, U.S. Pat. No. 4,798,386 entitled "Golf Ball With Fluorescent Cover") The symbols added to the core are more readable using the subject constant depth dimples than when spherical or other non-constant depth dimples are used. Also, the constant depth golf balls provide a different looking golf ball than those used in the prior art. In a separate embodiment of the present invention the golf balls have a two layer coating wherein the inner coating contains a pigment and has symbols printed on its surface. There is then a second layer that is clear that coats the symbols on the printed inner layer.

Methods of making golf balls according to the present invention are well known to one of ordinary skill in the art. One master pattern is then used to make mold cavities according to techniques well known to those of ordinary skill in the art. Golf balls can then be injection molded, compression molded or otherwise formed to give the golf ball the constant depth dimple patterns. Each of these techniques is well known to the skilled artisan.

DESCRIPTION OF THE PREFERRED EMBODIMENT

In the Figures, golf ball 10 has spherical surface 11 with a plurality of dimples 12 in its surface. Any suitable dimple pattern may be used such as the 332 dimple icosahedron pattern. Ball 10 has radius R1 (FIG. 3).

Each dimple 12 has a perimeter 12*p* which is the demarcation line of dimples 12 with surface 11. Preferably perimeter 12*p* is a circle but may be oval or other shape. If it is polygonal, it is preferred that it have more than four sides. The bottom 12*b* of each dimple 12 is curved with each bottom 12*b* being a portion of a sphere smaller than ball 10, such a sphere 14 having a radius R2 and a center coincident with the center of ball 10 (FIG. 3). Surface 11 is connected to bottom 12*b* through wall 12*w* which is substantially perpendicular to both. Bottom 12*b* is substantially the same size as the dimple opening defined by perimeter 12*p*.

Figure 2:
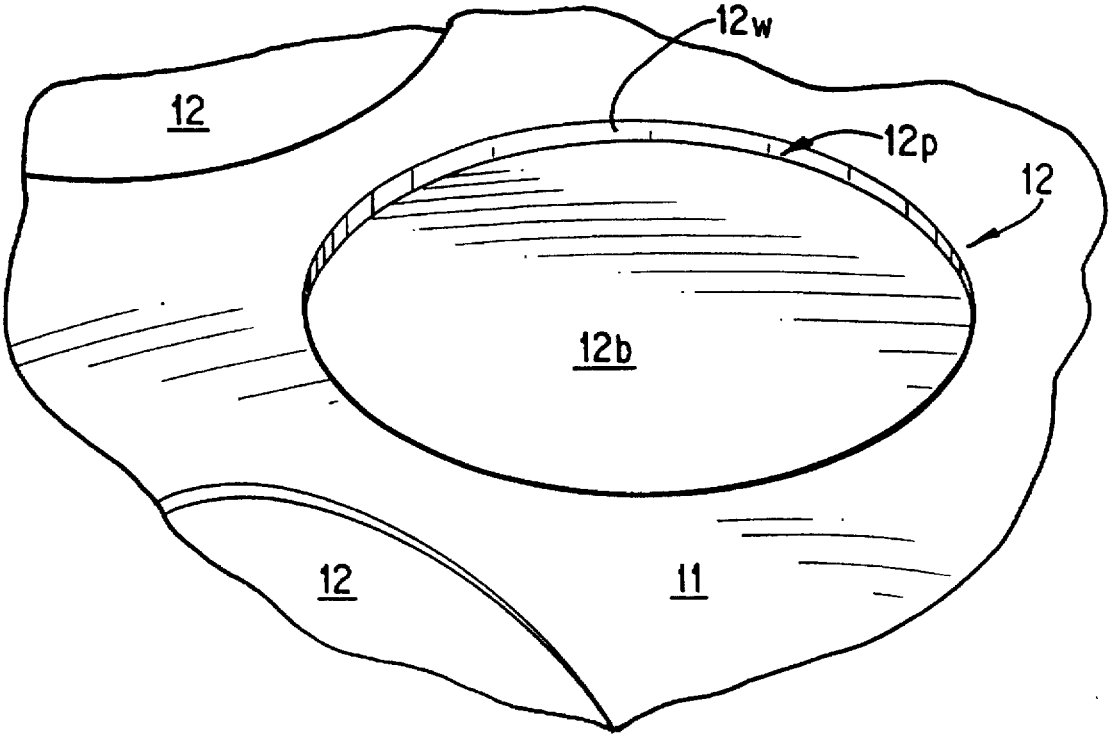
FIG. 2 is an enlarged partial perspective view of FIG. 1.
Figure 3:
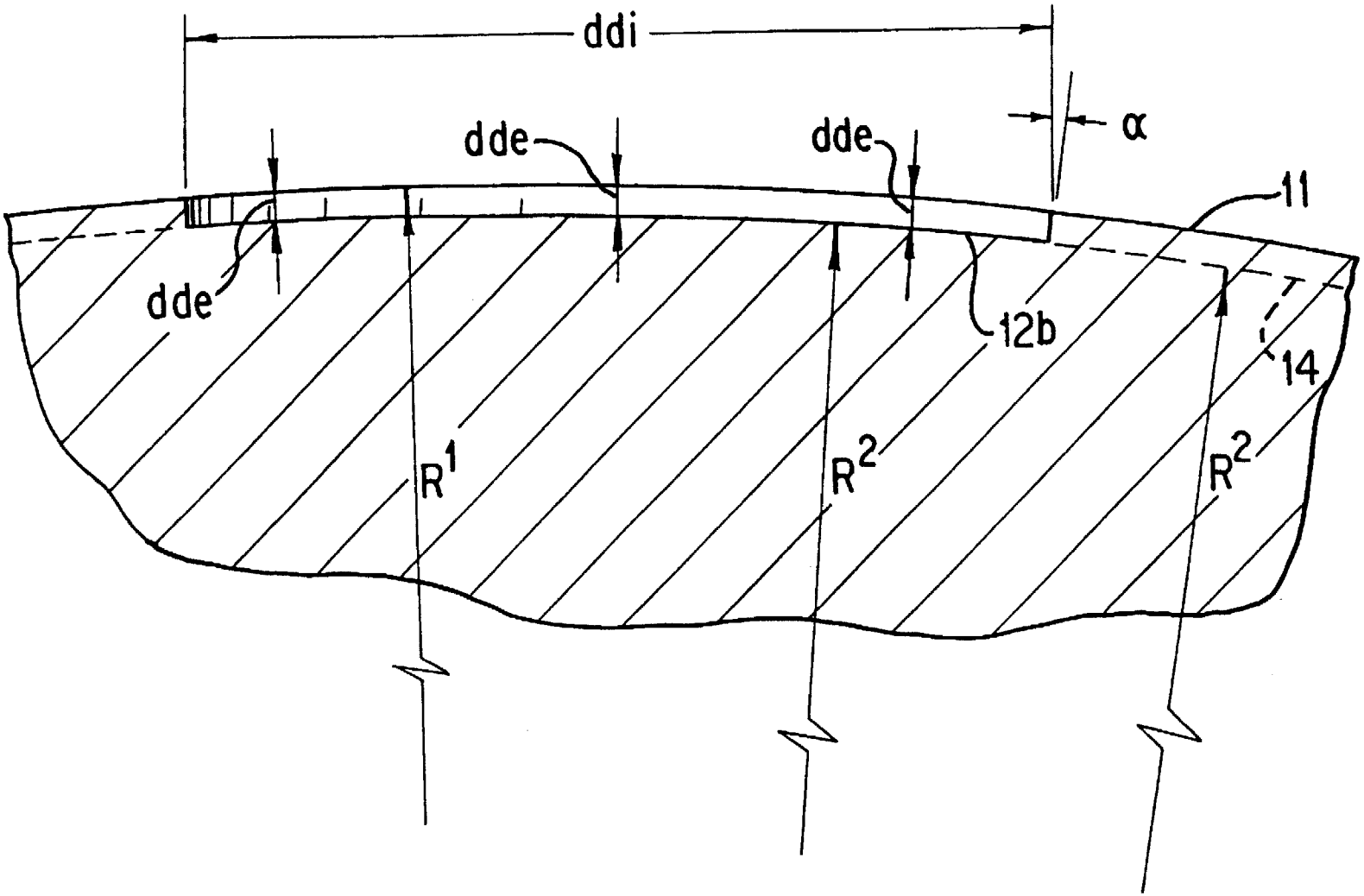
FIG. 3 is a sectional view along line 3—3 of FIG. 1.

Turning in particular to FIGS. 2 and 3, each circular dimple 12 has depths dde and diameters ddi. Depth dde measures the same at any point within dimple 12 creating a constant depth dimple. It is preferred that Ball 10 have dimple depths in the range of 2.5% to 5% of the dimple diameter. This is substantially shallower than conventional dimples whose depths are typically in the range of 6% to 8% of their diameters.

EXAMPLES

The present invention is further exemplified by the following examples in which all relative amounts are in parts by weight unless otherwise indicated. It should be understood that the present invention is not limited to the examples and changes and modifications may be made to the present invention without departing from the spirit and scope thereof.

Comparison flight test characteristics of the PINNACLE™ brand 332 dimple ball and a ball of the present invention having 332 dimples with each dimple having a 0.155 inch diameter and 0.0054 inch constant depth provided the following comparisons.

TABLE 1

| | Club | Avg. Carry (yards) | Total Distance (yards) |
|---|---|---|---|
| PINNACLE ™ 332 | Driver | 246.0 | 258.2 |
| Test ball | Driver (under same conditions) | 243.9 | 255.0 |

TABLE 2

| Club | Avg. Carry (yards) | Total Distance (yards) |
|---|---|---|
| Pinnacle 332 | 3-iron | 209.6 |
| Test ball | 3-iron (under same conditions) | 208.9 |
| Pinnacle 332 | 5-iron | 185.9 |
| Test ball | 5-iron (under same conditions) | 183.9 |
| Pinnacle 332 | 8-iron | 156.4 |
| Test ball | 8-iron (under same conditions) | 156.4 |

The constant depth dimples on the test ball were less than half the depth of the conventional dimples on the Pinnacle 332. A difference of this magnitude would normally be expected to cause a dramatic difference in flight distance, yet it is clear that the two configurations had very similar distances over a wide range of club types.

All patents, patent applications and other references cited in the foregoing text are herein incorporated by reference in their entirety.

The scope of the following claims is intended to encompass all obvious changes in the details, materials, and arrangement of parts that will occur to one of ordinary skill in the art:

I claim:

1. A golf ball in the shape of a sphere having a core and an outer cover, said cover defining an outer surface with a plurality of non-annular dimples in said outer surface, each dimple having a predetermined dimple perimeter on said outer surface to define an enclosed area having a diameter, the improvement wherein:

a) each dimple has a bottom surface area spaced radially inwardly of said outer surface;

b) said bottom surface area is substantially equal to the enclosed area defined by said perimeter; and c) said bottom surface area is at a constant depth from said outer surface along said diameter.

2. The golf ball of claim 1 wherein:

a) said core includes indicia thereon; and b) said cover is transparent.

3. The golf ball of claim 1 wherein:

a) between about 65 and 85% of said outer surface is covered with dimples.

4. The golf ball of claim 3 wherein:

a) all dimples are of the same construction.

5. The golf ball of claim 4 wherein:

a) each dimple has a circular perimeter with a predetermined diameter; and b) said constant depth is between about 2.5–5% of said diameter.

6. The golf ball of claim 5 wherein:

a) there are 332 dimples;

b) each dimple has a perimeter with a diameter of 0.155 inches; and e) said constant depth is 0.0054 inches.

7. The golf ball of claim 6 wherein:

a) the ball has a diameter of between about 1.680 and 1.750 inches.

* * * * *